United States Patent [19]

Forde et al.

[11] 4,336,774

[45] Jun. 29, 1982

[54] ROTATING IGNITER FOR ENGINES

[76] Inventors: Louis Forde; L. Gregory Forde; Alonzo Forde; Alfredo Forde; Raymond Forde, all of 482 Berriman St., Brooklyn, N.Y. 11208

[21] Appl. No.: 109,347

[22] Filed: Jan. 3, 1980

Related U.S. Application Data

[63] Continuation-in-part of Ser. No. 880,204, Feb. 22, 1978, abandoned, which is a continuation-in-part of Ser. No. 671,661, Mar. 29, 1976, abandoned.

[51] Int. Cl.[3] ..... F02P 15/00

[52] U.S. Cl. ..... 123/143 B

[58] Field of Search ..... 123/143 R, 143 B, 161, 123/190 DB

[56] References Cited

U.S. PATENT DOCUMENTS 1,383,075 6/1921 Clark ..... 123/190 BD X
1,501,505 7/1924 Walters ..... 123/143 R

FOREIGN PATENT DOCUMENTS 688057 5/1930 France ..... 123/143 R
462347 3/1937 United Kingdom ..... 123/190 BD

*Primary Examiner*—Michael Koczo, Jr.

[57] ABSTRACT

Disclosed herein is an apparatus for conveying igniters which periodically connect an energy source providing supply to thereby promote combustion in an engine comprising: the combination of a casing having a plurality of inspecting apertures and a corresponding plurality of outlets communicating a cavity about a central axis. A conveyor is the rotary member adapted within the casing. The rotary member includes equally spaced conduits carrying removably fitted igniters in circular motion around the central axis of the casing. The rotary member being driven from a synchronizer of the engine whereby separate conduit is periodically connected, to a conductor being attached to the energy source while simultaneously providing access into the respective chambers or cylinders of the engine to cause combustion therein in timed relation with the engine rotations.

6 Claims, 2 Drawing Figures

ROTATING IGNITER FOR ENGINES

FIELD OF INVENTION

This application is a continuation-in-part of application Ser. No. 880,204 filed Feb. 22, 1978 which is a continuation in part of Ser. No. 671,661 filed Mar. 29, 1976, both of which applications are now abandoned.

This invention relates to and is particularly concerned with providing ignition means for engines which have combustion chambers or cylinders.

Prior art proposals employ a high pressure distribution systems to supply stationary fuel injectors, one for each cylinder, so as to promote combustion in the engine.

Other engines of prior art designs are known to employ as the means for igniting the combustible mixture in the chambers or cylinders of an engine a secondary electrical distribution system requiring high voltage cables—one for each cylinder, a cap, a rotor, various connectors, dust boots, etc.

A stationary ignition plug is fitted into each combustion chamber and is connected to one of many cables of the system.

The cables absorb moisture which in combination with freezing temperatures or excessive heat cause decomposition resulting in cross-firings, misfirings and sometimes cease of operation.

Misfirings due to intentional or accidental disconnect result in power loss, therefore the excessive consumption of fuel.

Also, the numerical sequence of cable arrangement can be intentionally or accidentally rearranged resulting in malfunction of the engine.

Each ignition plug is constantly exposed to the various changing conditions—mostly adverse—occurring in the respective chamber which contribute to ignition plug fouling and further misfirings in the combustion chamber resulting in additional power loss and the excessive consumption of fuel.

In other prior art proposals the radial cylinder engine revolves about a gas distribution valve with igniting channel or channels, common to all of the cylinders, with the rotary axis at right angles to the engine. In such engines each cylinder carries a stationary electrically connected igniter in the housing.

In accordance with one preferred form of the invention the means for conveying ignition elements to periodically connect an energy source so to receive supply and promote combustion comprises: a plurality of promoting chambers equal in number to the number of cylinders in the engine adapted within a rotary member having a journal on each of its ends. The chambers within the member are arranged at equal angles in relation to each other.

An orifice intermediate an end of the rotary member and one chamber provides a channel within the rotary member.

A second orifice intermediate the same end and a second chamber provide another channel within the member.

Timing means is provided and is mounted on the rotary member and being coupled in a manner to rotate the rotary member in synchronism with the engine rotations.

More specifically, in the preferred embodiment of the invention, the rotary member conveying ignition means comprises: elements for providing ignition are removably fitted into channels within the rotary member defining ignition supply conduits disposed in planes arranged parallel to the axis of the rotation of the member so to be displaced in circular motion as the member is rotated during engine operation.

Still more specifically, in the preferred embodiment of the invention, the rotary ignition means comprises elements for ignition that are removably fitted in the channels defining ignition supply conduits disposed in planes arranged parallel to the axis of the rotation of the rotary member so to be displaced in a circular motion with the member.

The ignition supply conduits are spaced at equal angles within the member.

The conductor includes an input terminal being connected to the energy source providing means for communicating the source of supply and ignition conduit which fit into a bore positioned in the cover to provide contact with the rotary member means. A second bore is positioned in the cover and allows access to the ignition conduit means through the cover. A center bore is provided in the cover wherein a journal of the rotary member moves and rests.

The cover mates and encloses the rotary member in the casing which also has a center bore wherein a journal of the rotary member moves and rests.

The casing means includes a plurality of outlets positioned in axial alignment each in communication with a respective combustion chamber of the engine. Also, a plurality of access apertures, one for each chamber, are positioned in axial alignment in the casing means. The combination of the aperture and a bore, positioned in the casing, provide means for inspecting, testing and servicing the ignition supply conduit means.

Further in accordance with the invention, the input terminal on the conducting means being connected to an energy source receives supply from the source. In operation 1st ignition conduit means is placed in contact with the conducting means so that the 1st ignition conduit receives and conveys the supply into the 1st firing chamber upon the rotation of the rotary member. The supply passes from the 1st firing chamber and into the 1st explosion chamber all being in communication with each other to promote combustion therein.

And, subsequently, during engine operation the rotary member places the 2nd ignition conduit means in contact with the conducting means so to convey the supply from the energy source to the 2nd firing discharge chamber through 2nd outlet of the casing 2nd inlet and into the 2nd explosion chamber all being in communication with each other to promote combustion therein.

SUMMARY OF THE INVENTION

It is accordingly an object of the present invention to provide a device which avoids the aforementioned problems of prior art devices by introducing a synchronizer unit employing rotating timed igniters.

The principal object of the present invention is to provide a device wherein the rotary member has ignition conduits adapted within to convey the supply from a energy source enabling the combustion chambers of the engine in timed relation with the engine to operate rotations.

Still another object of the invention is to provide a device within an enclosure wherein the various elements are easily accessible for inspection, testing and servicing.

BRIEF DESCRIPTION OF THE DRAWINGS

In the drawings:

Referring now to FIG. 1, there is shown a member 10 rotatable in chamber 12 of casing 14 having an orifice 11 in which a journal of rotary member 10 moves and rests.

Figure 1:
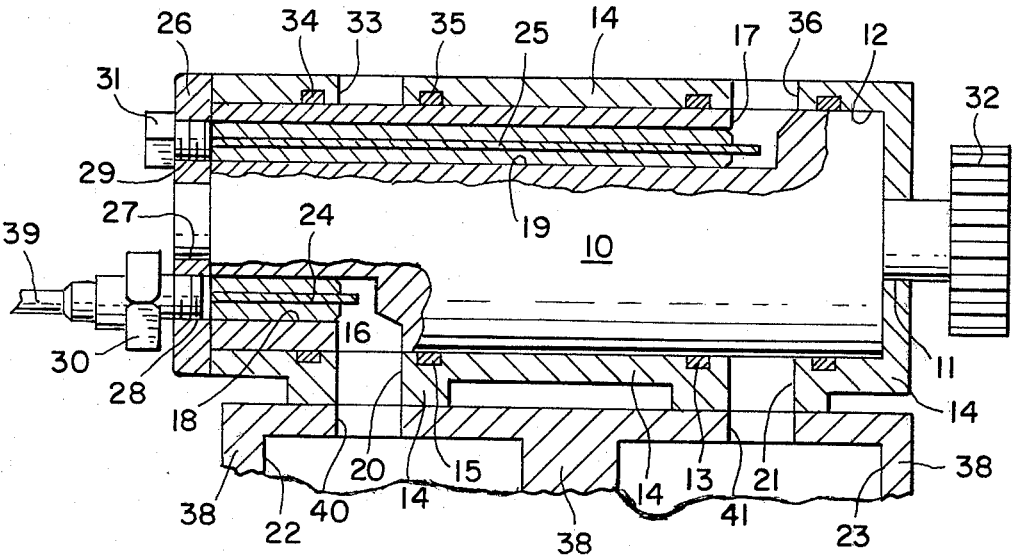
FIG. 1 is a sectional longitudinal elevational view of this invention.

First outlet 20 of casing 14 is shown interconnecting firing chamber 16 and 1st inlet of 1st combustion chamber 22 in engine block 38. The present, unique, versatile and useful invention contemplates the use of means supported in and including channels to convey into combustion chambers of an engine elements of varied forms and sizes including energy supplied from the following sources: beams of light amplification optical source, high fuel pressure source, high voltage source, fuel pellet an untopped energy source, or others. Straight line conveyance into the combustion chambers provides an alternative to the combination of central supply and peripheral distribution from conventionally used gas, liquid, or electrical sources.

An orifice defining 1st channel 18 and having 1st igniting means 24 fitted into it extends intermediate end of rotary member 14 and 1st firing chamber 16.

First inspecting aperture 33 is positioned in vertical alignment with first outlet 20 in casing 14.

Groove means 13 with sealing elements 15 fitted surround outlet 20. And groove means 34 with sealing elements 35 fitted surround first aperture 33. The sealing elements 15 and 35 are in sliding contact with rotary member 14 to prevent leakage from combustion chamber 22.

Another orifice defining second channel 19 and having the second igniting means 25 removably fitted into it extends intermediate 2nd firing chamber 17 and the same end of rotary member 14 as the first channel 18.

A second firing chamber 17, FIG. 1, is shown in communication with second inspecting aperture 36 of casing 14 and in vertical alignment with 2nd outlet 21 which is in communication with 2nd inlet 41 of second combustion chamber 23 of engine block 38. Grooves means 13 with sealing elements fitted surround the second outlet 21 and groove means 34 with sealing elements fitted surround second aperture 36.

Cover means 26 attached to casing 14 and enclosing rotary member 10 in the casing includes a center bore 27 wherein a journal of rotary member 10 moves and rests. A predeterminately positioned bore 28 in casing 26 carries conductor 30 including means which lead from the energy source. A second bore 29 is positioned in radial alignment with bore 28 in cover 26.

The second bore 29 provides access to 1st and 2nd promoter means at a respective time in the operating cycle. Cap screw 31 is fitted into second bore 29 which is provided for attaching, inspecting, testing and servicing instruments to cover 26.

Connector 39 on conductor 30 provides means which lead from the energy source.

Timing gear 32 shown mounted on rotary member 10 is being coupled to the prime mover (not shown) for displacing the member in synchronism with the engine rotations.

Figure 2:
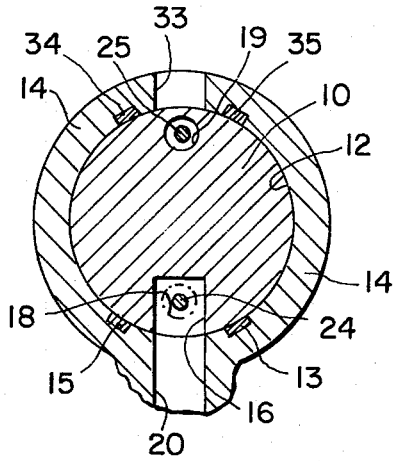
FIG. 2 is a cross sectional elevational view of an embodiment of the invention.

In FIG. 2 the member 10 is shown rotatably disposed in chamber 12. 1st firing chamber 16 with first channel 18 having igniting element 24 removably fitted and in registry with first outlet 20 of casing 14.

Groove means 13 with sealing elements 15 are shown in FIG. 2 adjacent outlet 20. The seal is shown in sliding contact with rotary member 10.

Identical groove means 34 with sealing elements 35 fitted are in sliding contact with rotary member 10 and surround first inspecting aperture 33 as they do the 2nd inspecting aperture 36.

The second channel 19 with igniting element 25 is shown radially aligned with 1st channel 18 and 1st igniting element within rotary member 14.

While the invention has been described by means of specified embodiments, we do not wish to be limited thereto, for obvious modifications will occur to those skilled in the art without departing from the spirit and scope of the invention.

We claim:

1. Apparatus for conveying igniters in an engine comprising: synchronizing casing means including first inspecting apertures means positioned in radial alignment with first outlet means positioned in said casing, and second inspecting aperture means positioned in radial alignment with second outlet means positioned in said casing, conveying means consisting of rotary member means rotated within said casing; means for rotating the member in synchronism with the engine rotations, said rotary member having disposed within first firing means and second firing means arranged at equal angular relationship with each other and vary-distant from an end of said rotary member means, first orifice means intermediate said first firing means and said end of said rotary member means defining first channel means within said rotary member means, igniting elements removably fitted into said first channel means defining first conduit means, second orifice means intermediate said second firing means and said end defining second channel means, igniting elements removably fitted into said second channel means defining second conduit means within said rotary member means, said first and said second conduit means disposed in planes arranged parallel to the axis of the rotation of said rotary member means having journal means moving and resting in said casing means and in cover means mating and enclosing said rotary member within said casing means, said cover means includes a first predeterminely positioned bore, conducting means including an input connector removably fitted into said bore, said conducting means being connected to an energy source, wherein upon rotation said rotary member means places said 1st conduit means in alignment with said conducting means, wherein said 1st conduit means conveys supply from said source into said first outlet means, and wherein said second inspecting aperture is in registry with and providing access into said second firing means at a respective time in the cycle.

2. The combination of claim 1 and wherein said rotary member means, subsequently places said 2nd conduit means in alignment with said conducting means in said cover means wherein said 2nd conduit means conveys supply from said source into said second outlet means, and wherein said first aperture is in registry with and providing access into said first firing means at respective time in said cycle.

3. The combination of claim 1 and further comprising groove means with elements fitted and disposed within said casing means surround said first and said second outlet means, respectively and said first and said second aperture means, respectively, and are in contact with said rotary member to provide sealing against leakage from the combustion chambers.

4. The combination of claim 1 and wherein said cover means further includes second bore means positioned so as to provide access to said conduit means and for adapting servicing means, screw means removably placed into said second bore.

5. The combination of claim 3 and wherein said first outlet means connects a first combustion chamber through first inlet.

6. The combination of claim 2 and wherein said second outlet means connects a second combustion chamber through second inlet.

* * * * *